US005709990A

United States Patent [19]

Jezequel et al.

[11] Patent Number: 5,709,990

[45] Date of Patent: Jan. 20, 1998

[54] METHOD FOR PREPARING A PHOTOGRAPHIC EMULSION, AND APPARATUS FOR IMPLEMENTING THE METHOD

[75] Inventors: Pierre Henri Jezequel, Givry; Christian Serge Emile Schmuckle, Chalon sur Saone, both of France

[73] Assignee: Eastman Kodak Company, Rochester, N.Y.

[21] Appl. No.: 761,057

[22] Filed: Dec. 5, 1996

[30] Foreign Application Priority Data

Dec. 14, 1995 [FR] France ..... 95 15009

[51] Int. Cl.[6] ..... G03C 1/015; B01F 5/10

[52] U.S. Cl. ..... 430/569; 430/30; 422/225; 422/234

[58] Field of Search ..... 430/569, 30; 422/225, 422/234

[56] References Cited

U.S. PATENT DOCUMENTS

| | | | |
|---|---|---|---|
| 3,415,650 | 12/1968 | Frame et al. | 430/642 |
| 3,482,982 | 12/1969 | Miyata | 430/569 |
| 3,650,757 | 3/1972 | Irie et al. . | |
| 3,655,166 | 4/1972 | Sauer et al. | 366/162.1 |
| 3,790,386 | 2/1974 | Posse et al. | 430/569 |
| 3,897,935 | 8/1975 | Forster et al. | 366/339 |
| 4,046,576 | 9/1977 | Terwilliger et al. | 430/569 |
| 4,147,551 | 4/1979 | Finnicum et al. | 430/567 |
| 4,242,445 | 12/1980 | Saito | 430/569 |
| 4,758,505 | 7/1988 | Hoffmann | 430/569 |
| 5,104,786 | 4/1992 | Chronis et al. | 430/569 |
| 5,334,496 | 8/1994 | Pond et al. | 430/569 |

FOREIGN PATENT DOCUMENTS

| | | | |
|---|---|---|---|
| 0222252 | 10/1986 | European Pat. Off. | G03C 1/02 |
| 0523842A1 | 1/1993 | European Pat. Off. | G03C 1/015 |
| 2340082 | 3/1974 | Germany | G03C 1/02 |
| 1243356 | 8/1971 | United Kingdom | G03C 1/02 |
| 2022431 | 12/1979 | United Kingdom | G03C 1/05 |

OTHER PUBLICATIONS

Research Disclosure No. 36544, Sep. 1994, "Emulsion Grains and their Preparation".

*Primary Examiner*—Mark F. Huff
*Attorney, Agent, or Firm*—Mark G. Bocchetti

[57] ABSTRACT

The invention relates to a method and a device for preparing a photographic emulsion.

In the device of an external loop type of the invention, a solution of a first halide salt $X_1^-$ is introduced at a point in the loop situated outside the reaction zone R within which the silver salt ($Ag^+$) added to the loop precipitates almost entirely in order to produce silver halide grains or cause them to grow in said solution, the $Ag^+$ solution being introduced into the reactor in the form of a "centered" jet within said reactor, the Reynolds number Re at the point of introduction of the $Ag^+$ salt being between approximately 5000 and approximately 50,000.

27 Claims, 4 Drawing Sheets

METHOD FOR PREPARING A PHOTOGRAPHIC EMULSION, AND APPARATUS FOR IMPLEMENTING THE METHOD

FIELD OF THE INVENTION

The invention concerns the field of the preparation of silver halide photographic emulsions, and concerns in particular the methods and devices for preparing emulsion of the external circulation loop type.

BACKGROUND OF THE INVENTION

Typically, silver halide grains are produced by reacting an aqueous solution of a silver salt with an aqueous solution of a halide salt in a stirred solution of gelatin contained in a reactor.

To do this, and according to a first, so-called "single jet" technique, a solution of aqueous silver salt is added to an aqueous solution of gelatin and halide contained in a reactor stirred continuously. By way of example, U.S. Pat. No. 3,482,982 describes the introduction of halide ions either in crystalline form or in the form of a soluble salt during precipitation by a single silver bromoiodide jet.

According to another, so-called "double jet" technique, a silver salt solution (for example of silver nitrate) and a solution of at least one halide salt (for example potassium bromide, potassium iodide or potassium chloride) are added simultaneously and separately, at controlled flow rates, to a solution of gelatin stirred continuously by means of a stirrer whose speed typically varies between 1500 and 5000 rev/min. The temperature of the reactor depends on the characteristics of the emulsion and preferably varies between 40° and 75°. Examples of the preparation of emulsions using the double jet technique are described in U.S. Pat. Nos. 3,415,650; 3,650757; 3,790,386; 3,897,935; 4,046,576; and 4,242,445; etc.

A technique substantially equivalent to the double jet technique is also described in French patent No 2,072,060, according to which a photographic emulsion is produced continuously by means of a pulsed reactor into which reagents necessary for the production of silver photographic grains are added separately.

According to yet another, more recent approach, a technique is used which employs an external circulation loop to recirculate the content of the vessel in which the emulsion is prepared. As shown in FIG. 1, a gelatin solution and at least one halide salt contained in a vessel 1 is stirred continuously by means of a stirrer 5 and pumped (pump 2) continuously at a controlled rate, to be channeled into a reactor 3 wherein a halide salt solution and a silver salt solution are added through a single entry point. The solution emerging from the reactor 3 is recycled in the evaporating vessel 1.

Such systems with an external circulation loop have been extensively described in the patent literature. Thus, for example, the patent U.S. Pat. No. 5,104,786 entitled "Plug flow processes for the nucleation of Silver Halide Crystals" describes a system of this type, designed in such a way that the nuclei can pass through the reactor of the external loop only once.

Patent application EP-A-0 523 842, entitled "Apparatus for production of sparingly water-soluble salt crystal grains" describes a device in which the external loop is used for the continuous supply of ultra-fine silver halide grains produced in a separate mixer so that there exists a slight supersaturation in the loop and in the main vessel so as to allow dissolution of these ultra-fine crystals by Ostwald's maturation in favor of the pre-existing crystals.

One of the problems with such an approach lies in the fact that it is nevertheless possible to produce in this way irreversibly insoluble species in the form of aggregates or packets formed mainly from silver salts and gelatin and which can foul or even block the circuits used during and after precipitation and more generally the devices in which the photographic emulsions thus produced are caused to flow. Thus, for example, such packets may cause a fouling of the ultrafiltration membranes. It is frequently considered that the production of such aggregates results from the existence of non-ideal conditions in the reaction zone and more generally poor homogenization of the reagents used during precipitation in the reaction medium.

U.S. Pat. No. 4,147,551 describes a system with an external circulation loop in which silver halide grains can be precipitated in an environment which is controlled but different from that existing in the main reactor. The objective of the invention described is the precipitation of emulsions systematically containing two halide salts, one of which, less soluble, is initially present in the main reactor whereas the second, more soluble, is continuously added to the reaction loop, along with the silver salt but at a different position from it, so that partial substitution in the crystals of the more soluble halide for the less soluble halide is progressively achieved in the main reactor. By preventing direct precipitation of the silver salt with the second halide salt, better control of the internal structure of the grains is thus afforded. Although the importance of stirring in the circulation loop is emphasized, the operating methods described do not specify the optimum conditions for preventing the formation of undesirable insoluble species. Notably, with regard to the Reynolds number, the conditions are such that the Reynolds number is too low (Re=2583 for Example 5, which gives rise to a long mixing length), or too high (Re>150,000 for Examples 3 and 4) which entails a high energy consumption.

Another problem which arises in the field of the preparation of emulsions lies in the passage from an experimental or developmental scale to an industrial scale. Typically, the process of preparing an emulsion involves intensive variables such as temperature, pAg and concentrations, which are independent of the scale of production, and extensive variables such as pumping rates and initial volumes which should vary linearly when there is a move from a first scale (laboratory type) to an industrial production scale. However, problems related to the sizing of precipitation equipment on several scales must also be taken into account, since this sizing cannot generally follow linear laws. This is the case in particular for the sizing of stirrers affording optimum dispersion of reagents in vessels, or injectors of reagents into loops. Consequently, the change from an emulsion preparation process in a 101 vessel to a 1001 vessel can necessitate long, costly adjustments, owing principally to their empirical nature. In other words, changing from a scale 1 to a scale 10, and then to a scale 100, does not routinely take place automatically and immediately simply by increasing the size of the vessel, the pumping rate and the size of the reactor by a factor of 10 or 100.

According to a first known approach, both the intensive variables (T°, pAg, Concentration) and the extensive variables of the precipitation formula are modulated. This technique has often proved insufficient owing to its awkward and uncertain nature.

According to another approach, the stirring in the vessel is acted on by modifying, for example, the diameter of the stirrer, the residence time in the external loop, the dilution ratio, etc. The drawback with this technique relates mainly to the difficulty associated with the changing of equipment for different precipitation formulae.

U.S. Pat. No. 4,147,551 mentioned above suggests the use of a plurality of external circulation loops in parallel and mentions in particular the use of a first loop into which the silver salt would be introduced, and a second loop for the introduction of the halide salt. This approach, of the type with several different loops, does not contribute in any case to resolving the problem associated with the change of scale as described above.

Thus one of the objects of the present invention is to provide a method and a device for the preparation of a photographic emulsion which do not exhibit the drawbacks discussed above with reference to conventional techniques.

Another object is to provide a device and a method for producing a photographic emulsion without producing irreversibly insoluble species to a significant extent.

Other objects of the present invention will appear in detail in the following description.

SUMMARY OF THE INVENTION

These objects are achieved according to the invention by means of a method for preparing a silver halide photographic emulsion in which the contents of a vessel (10) containing at least a stirred solution of gelatin is circulated in an external circulation loop (13) including a reactor (12) at which a first solution of a silver salt $Ag^+$ and second solution of a first halide salt $X_1^-$ are added, the $Ag^+$ solution being introduced at a point 30 situated upstream of the point of introduction 31 of the $X_1^-$ solution, the method being characterized in that the second solution of the said first halide salt $X_1^-$ is introduced at a point 31 in the loop situated outside the reaction zone R within which the silver salt ($Ag^+$) added to the loop precipitates almost entirely in order to produce silver halide grains or cause them to grow in the said solution, in that the $Ag^+$ solution is introduced into the reactor 12 in the form of a "centered" jet within the said reactor and in that the Reynolds number Re at the point of introduction (30) of the $Ag^+$ salt is between approximately 5000 and approximately 50,000.

According to the invention, a device of the type with an external circulation loop is also produced to prepare a silver halide photographic emulsion comprising:

a) a vessel (10) initially containing at least a stirred solution of gelatin;

b) pumping means (11) for pumping the said solution continuously into the vessel (10);

c) an external circulation loop (13), fed by the said pumping means and including a reactor (12) at which a first solution of a silver salt ($Ag^+$) and a second solution of a first halide salt are added; the $Ag^+$ solution being introduced at a point 30 situated upstream of the point of introduction 31 of the $X_1^-$ solution, and d) means (24) for continuously recycling the output of each of the circulation loops in the vessel (10);

the device being characterized in that the second solution of the said first halide salt $X_1^-$ is introduced at a point 31 in the loop situated outside the reaction zone R within which the silver salt ($Ag^+$) added to the loop precipitates almost entirely in order to produce silver halide grains or cause them to grow in the said solution, in that the $Ag^+$ solution is introduced into the reactor 12 in the form of a "centered" jet within the said reactor and in that the Reynolds number Re at the point of introduction (30) of the $Ag^+$ salt is between approximately 5000 and approximately 50,000.

BRIEF DESCRIPTION OF THE DRAWINGS

In the detailed description that follows, reference will be made to the drawing, in which.

DETAILED DESCRIPTION OF THE PREFERRED EMBODIMENTS

Figure 1:
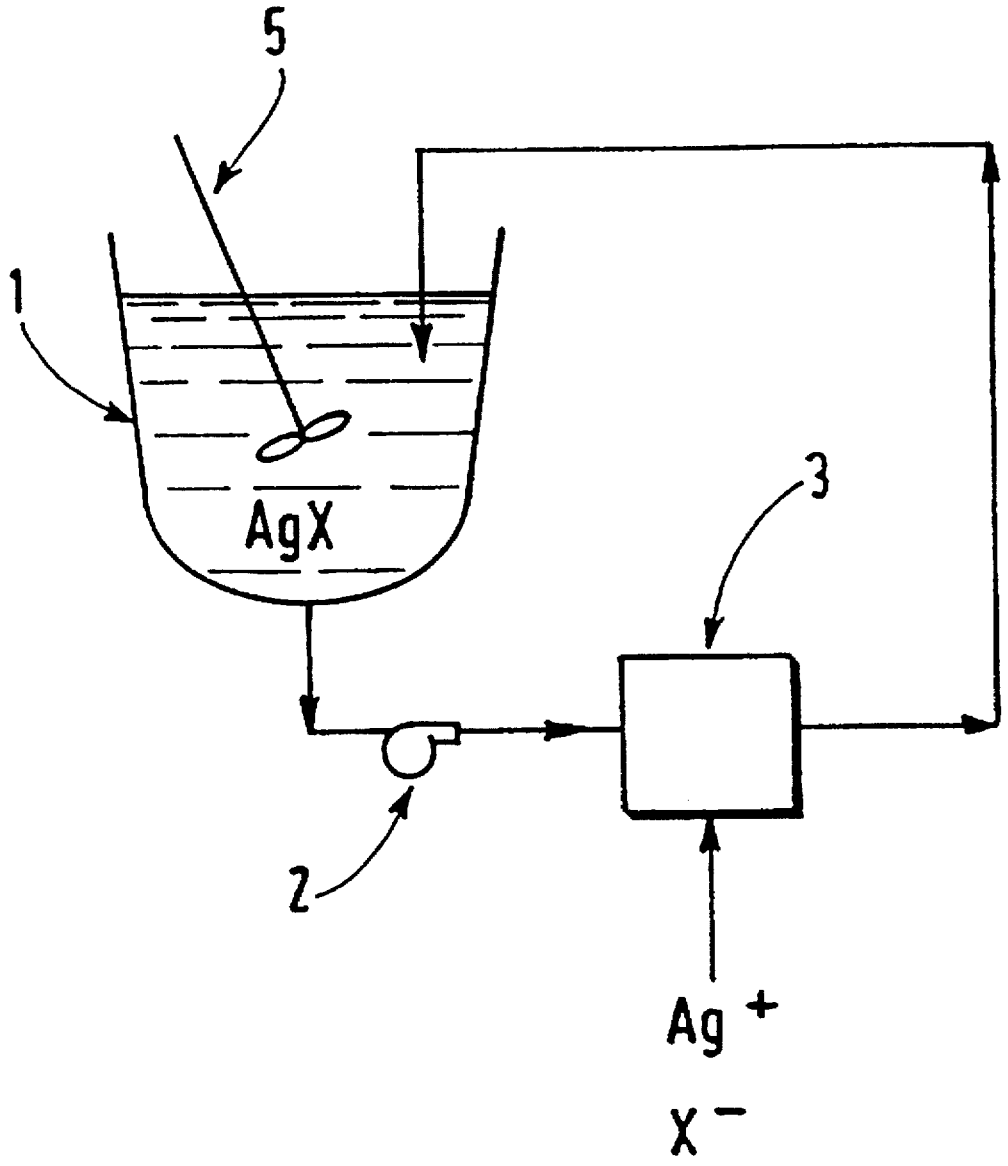
FIG.1 PRIOR ART
FIG. 1 depicts a device with an external circulation loop, known in the prior art.
Figure 2:
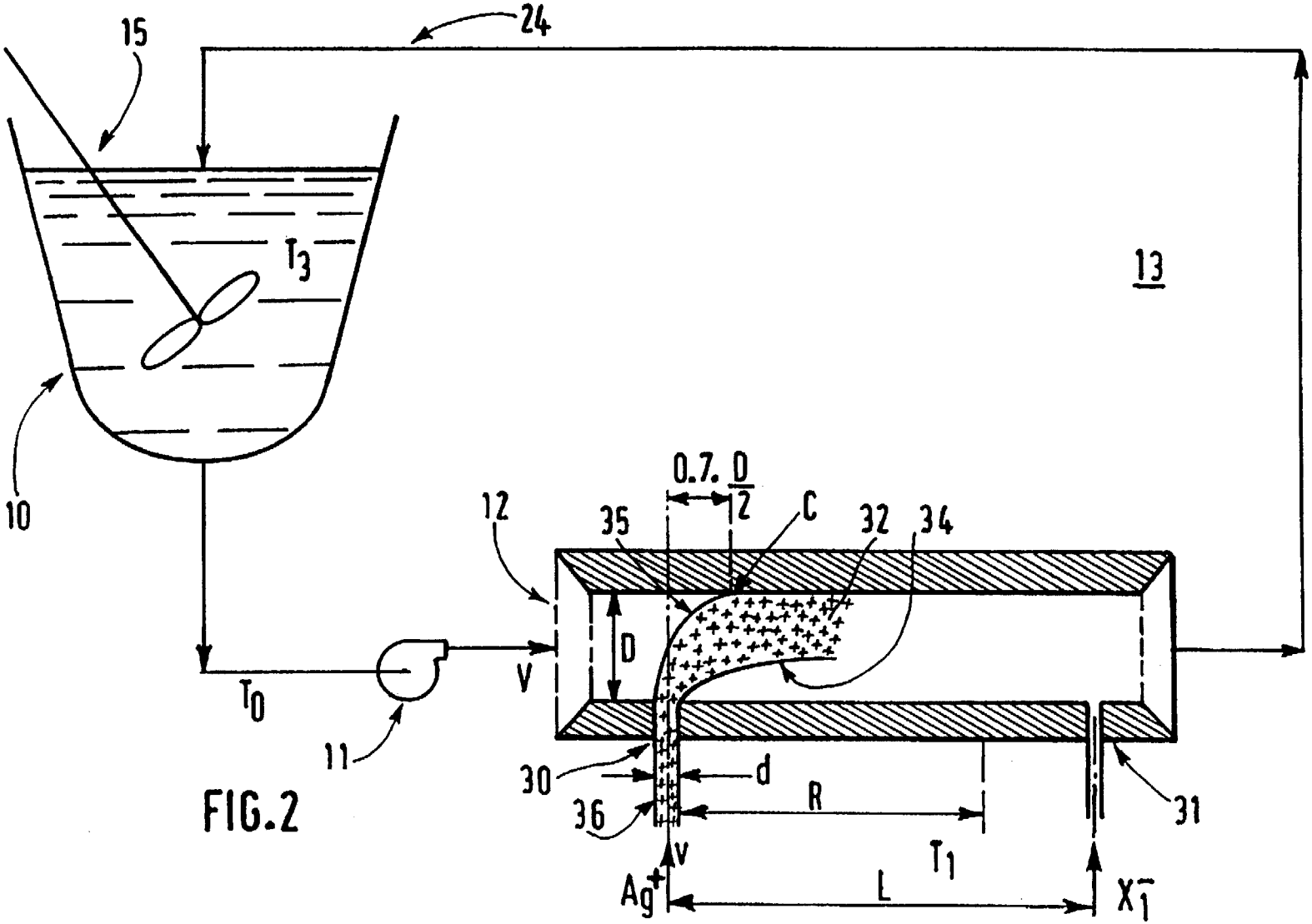
FIG. 2 depicts diagrammatically a preferred embodiment of the device according to the present invention.

FIG. 2, to which reference is now made, illustrates diagrammatically an embodiment of the device according to the invention.

According to the invention, it was discovered that three main characteristics had to be combined with each other to resolve, in a satisfactory manner, the problem related to the irreversibly insoluble species. A fourth characteristic, relating to the average sizing of the recirculation loop, can be combined with the first three in a preferred embodiment of the invention.

As illustrated in FIG. 2, a stirred gelatin solution (as well as, optionally, a halide salt) contained in a vessel 10 is pumped 11 at a controlled flow rate and sent into an external circulation loop 13 including a reactor 12 before being recycled continuously in the vessel 10. Within the meaning of the present application, the term "reactor" does not necessarily designate an individualizable component of the circulation loop but designates the portion of the loop situated downstream of the first point of introduction of one of the reagents and in which the reaction of formation and/or growth of the grains at least partially occurs. At the reactor 12, a first solution of a silver salt $Ag^+$ and a second solution of a halide salt $X_1^-$ are introduced.

According to a first characteristic of the invention, the respective points of introduction 30 and 31 of the $Ag^+$ and $X_1^-$ are separated by a distance L greater than the length R of the reaction zone in which the $Ag^+$ salt introduced at the point 30 precipitates almost entirely (and preferably entirely) with the solution pumped from the vessel 10. Thus the halide salt $X_1^-$ introduced at the point 31 does not directly contribute to the precipitation and acts only after having passed into the vessel 10, where homogenization with the contents of the vessel is effected. By way of example, the points of introduction 30 and 31 of the two reagents are separated by a distance of 0.45 m.

In reality, the optimum distance required between the points of introduction of the reagents is not constant from one precipitation to another. It depends on several factors:

the molar concentration of halide salt in the fluid flowing in the circulation loop, the diameter of the circulation loop;

the molar concentration of $Ag^+$ salt injected into this loop; and the diameter of the $Ag^+$ salt injector.

Typically, for a flow rate of 20 l/min in a reactor with a diameter of 10 mm and a molar concentration of halide salt of 0.03 moles/liter, a silver salt of molarity 1M injected through a 0.7 mm orifice precipitates in a reaction zone with a length of approximately 0.25 m.

It is nevertheless obvious that this condition cannot be complied with where the molar quantity of silver salt introduced in the recirculation loop per unit time is greater than the molar quantity of halide salt flowing per unit time in the circulation loop, as may be the case during precipitations with low pAg, in which case precipitation of the $Ag^+$ salt with the $X_1^-$ salt situated upstream is inevitable. It is however still necessary to ensure complete precipitation of the halide salt circulating in the reaction loop with the $Ag^+$ salt solution before the $X_1^-$ salt is introduced into the loop. In this situation, it may also be desirable to reverse the respective order of introduction of the two $Ag^+$ and $X_1^-$ salts, in which case complete mixing of the two halide salts must be achieved before the $Ag^+$ salt is added downstream.

The second characteristic of the invention relates to the design of the reactor, which must be such that the $Ag^+$ solution introduced into the reactor 12 produces a "centered" jet within the reactor 12 in order to optimize simultaneously the micro-mixing and macro-mixing characteristics.

As is shown diagrammatically, the term "centered" signifies, within the meaning of the present application, that the jet separates from the wall of the reactor 12 on which the point of introduction is situated so that the species introduced do not immediately come into contact with the wall. In other words, the jet of $Ag^+$, individualized in the flow within the reactor 12, has a lower limit 34 which is not in immediate contact with the wall of the reactor 12 at which the introduction of the $Ag^+$ salt is situated. As for the point of contact of the upper limit 35 of the jet 32 with the opposite wall of the reactor 12, it is desirable for it be situated at a distance (with respect to the axis of the $Ag^+$ inlet tube 36) which is at least equal to 0.7 times the radius of the reactor 12.

The condition relating to the centering of the jet results in conditions relating to the respective diameters D, d, of the reactor 12 and $Ag^+$ inlet tube 36, and to the respective velocities V, v, of the flow in the reactor 12 and in the inlet tube 36. Preferably the ratio d/D lies between 0.05 and 0.5 and more preferably between 0.07 and 0.2. As for the ratio v/V, this preferably lies between 0.02 and 15, more preferably between 0.2 and 3, and more preferably between 0.2 and 1.8, these values being relative to injectors perpendicular to the direction of the main flow.

This condition relating to the centering of the jet can be optimized by orientating the $Ag^+$ inlet tube so that its axis forms an angle other than 90° with respect to the axis of the reactor 12 and directed so that the $Ag^+$ salt is introduced in counter-flow with respect to the direction of flow in the reactor 12. Good results have been obtained with an angle of 45° with respect to the axis of the reactor.

The third characteristic of the invention relates to the flow conditions in the circulation loop. These conditions are commonly defined by the Reynolds number Re of the flow:

$$Re=Ud/v$$

where U is the characteristic velocity of the flow;

d is the diameter of the pipe; and v is the kinematic viscosity of the flowing fluid.

It is well known that values of this number above approximately 2500 give rise to turbulent flows. It was discovered according to the invention that increasing this number to values greater than approximately 5000 and preferably greater than approximately 15,000 made it possible to reduce the propensity of the emulsions precipitated to produce new crystals by renucleation during the stages of growth of the crystals existing after the nucleation phase. According to the invention, the Re at the point of introduction of the $Ag^+$ salt is preferably less than approximately 50,000.

According to a fourth characteristic, used in a preferred embodiment of the invention, the diameter of the pipes forming the circulation loop is preferably below 15 mm. Thus, during any change from production scale 1 to scale 10 and then to scale 100, this dimension will remain constant for each of the circulation loops, the change taking place with regard to the number of loops employed, as described diagrammatically in FIGS. 4A and 4B. Preferably this diameter will lie between 6 and 15 mm, and more preferably between 8 and 12 mm.

According to a possible embodiment, the reactor 12 takes the form of a cylindrical (generated by rotation, for example) tubular element, open at both ends, one for receiving the solution pumped into the evaporating vessel 10, the other for the output of the solution after addition.

By way of example, using a circulation loop of the type depicted in FIG. 2, with a solution whose kinematic viscosity is around $10^{-6}$ $m^2/s$, the pumping rate is preferably between 8 and 20 l/min. As regards the residence times for the solution in the various portions of the loop, four residence times are to be taken into account, corresponding to the four portions of the loop: the time $T_0$ corresponding to the residence time between the vessel and the point of introduction of the silver salt; the time $T_1$ corresponding to the portion of the loop between the point of introduction of the silver salt solution and the point of introduction of the halide salt; $T_2$ corresponding to the time between the point of introduction of the halide salt and the vessel; and $T_3$, the average residence time in the evaporating vessel as defined hereinafter.

$T_3$ can be measured in different ways. By way of example, the following method is used: a ball (for example made of plastic) with zero floatability (with a tolerance of plus or minus 2 cm/s) is introduced into the vessel; at a fixed point in the external circulation loop (for example at the inlet to the reactor), means are disposed for detecting the passage of the ball; the time elapsing between two successive passages of the ball in front of the detection means is measured; the times $T_0$, $T_1$ and $T_2$ being known, the residence time of the ball in the vessel is derived therefrom; a distribution curve is then traced for residence times (TS); a normed distribution is derived therefrom, from which the integral of the normed distribution (DI) is calculated; a curve is then traced which has the time TS as its X-axis and DS=1−DI as its Y-axis; thus a point with coordinates $TS_0$, $DS_0$ represents the probability that a ball has a residence time greater than $TS_0$ in the vessel; the curve obtained substantially forms a straight line with a negative slope, the residence time in the vessel $T_3$ being the slope of the straight line.

$T_3$ is not fixed during precipitation, since it increases with the increase in volume in the vessel. On the other hand, $T_3$ is fixed from one scale to another to within plus or minus 20%, and preferably to within plus or minus 10%. In other words, at a time t in a scale 1 precipitation, the average residence time $T_3$ is identical (to within ±20% or ±10%) to T3 in a scale N precipitation at the same time t. Consequently, the positioning of the points of introduction to and removal from the vessel is acted on by varying the distance separating them; similarly, it is possible to act on the residence time by using means of the deflector type positioned in the vessel so as to modify the time $T_3$. By way of example, $T_3$ can vary from 5 to 60 secs between the start and end of precipitation.

$T_0$ is not a critical parameter. It can vary even if the scale is changed. In reality, it represents the residence time of the emulsion in a state of quasi-equilibrium. Typically, $T_0$ is significantly less than $T_3$ (typically 0.5 s), and preferably less than or equal to 10% of $T_3$. Also preferably, $T_0$ is less than or equal to 1% of $T_3$.

$T_1$ is a critical parameter for many emulsions, since it influences the mixing length L relative to the length of the reaction zone. Preferably, $T_1$ varies between 8 ms and 1000 ms. Also preferably, $T_1$ varies between 30 and 200 ms.

$T_2$ is also an important parameter, since it can condition the effects related to Ostwald's maturation. This time does, however, depend to a large extent on the emulsion that is to be produced. Typically, $T_2$ varies between 300 and 1500 ms.

Another important parameter during the preparation of a photographic emulsion is the molar ratio $R_1$, expressed by the equation:

$$R_1 = \frac{C_x^k - Qp}{CAgQAg}$$

in which:

CAg is the silver salt concentration;

$Q_p$ is the pumping rate in the vessel;

QAg is the feed rate of the $Ag^+$ salt solution;

$C^k_{x-}$ is the halide concentration in the evaporating vessel.

This ratio expresses how the silver halide salt injected into the reactor is mixed with the salt pumped into the vessel. $R_1$ is related to the local pAg of the reaction zone and can vary greatly from one experiment to another, or even in the course of a single precipitation. The molar ratio $R_1$ is greater than 1, preferably strictly, and can be as high as 15, for example.

Figure 3A:
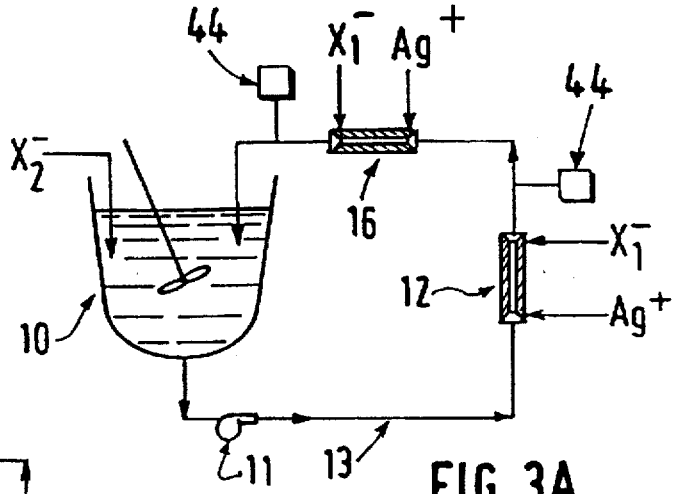
FIGS. 3A–3D illustrate diagrammatically various possibilities for the introduction of reagents in the device according to the invention.

FIG. 3A depicts another embodiment of the reference loop. According to this approach, a silver salt solution $Ag^+$ and a solution of a first halide salt $X_1^-$ are introduced into the circulation loop 13 at the reactor 12, the point of introduction of the $X_1^-$ salt solution being offset in the direction of flow of the fluid with respect to the entry point of the $Ag^+$ salt. Furthermore, a second halide salt $X_2^-$ is introduced into the evaporating vessel 10. Such an approach affords the advantage of being able to modulate the pAg locally and notably facilitates the formation of certain photographic grain morphologies. The pAg is controlled by using a probe 44, placed either in the circulation loop (FIG. 3A), downstream of the reactor (or reactors), or directly in the evaporating vessel (FIG. 4B), the latter solution being preferred since the noise in measurement is lower. The result of the measurement of the pAg measurement probe (or probes) is used to control the rates of introduction of reagents.

Similarly, as illustrated in FIG. 3A, the circulation loop can comprise two or more reactors 12 and 16 disposed in series so that a silver salt solution, and optionally a halide salt solution, can be introduced into several portions of the external circulation loop, the effect of which will be to allow an increase in the rates of production of the emulsion, that is to say increasing the number of moles produced per unit of time.

Figure 3B:
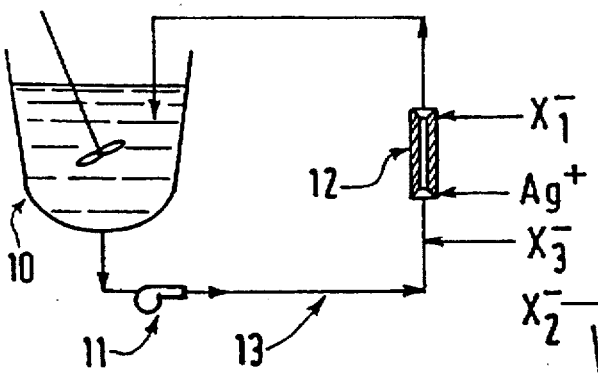

In the approach illustrated in FIG. 3B, a halide salt solution $X_3^-$ is introduced into the circulation loop 13 upstream of the point of introduction of the $Ag^+$ salt solution. This approach also enables the pAg to be increased or the dilution ratio to be increased locally before the reaction, which can, in certain cases, offer the advantage of generating flat photographic grains of lower thickness.

Figure 3C:
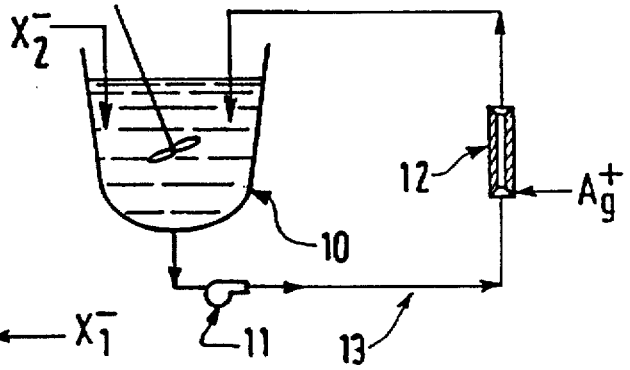

In the embodiment in FIG. 3C, the halide salt $X_2^-$ is introduced solely into the vessel, only the $Ag^+$ salt being introduced into the circulation loop 13, thereby enabling the reaction zone to be isolated from the rest of the device and enabling the local environment of the crystals to be modified.

Figure 3D:
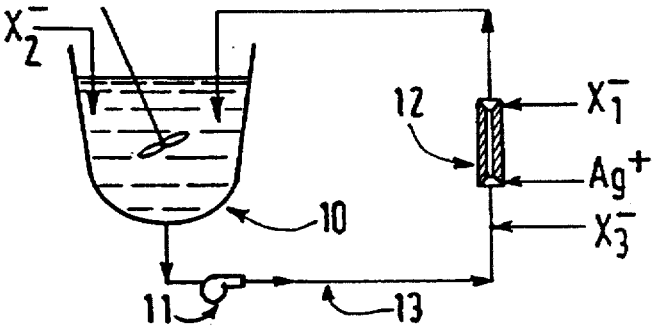

In the example illustrated in FIG. 3D, a first halide salt $X_3^-$ is introduced into the external circulation loop 13 upstream of the reactor 12, a silver salt solution is introduced at the inlet to the reactor 12, a second halide salt $X_1^-$ is introduced into the reactor downstream of the point of introduction of the silver salt, and a third halide salt $X_2^-$ is introduced into the vessel 10.

All these examples of configurations of reference loops are given solely by way of illustration. It is evident that, depending on the emulsion to be produced, other configurations can be envisaged.

Figure 4A:
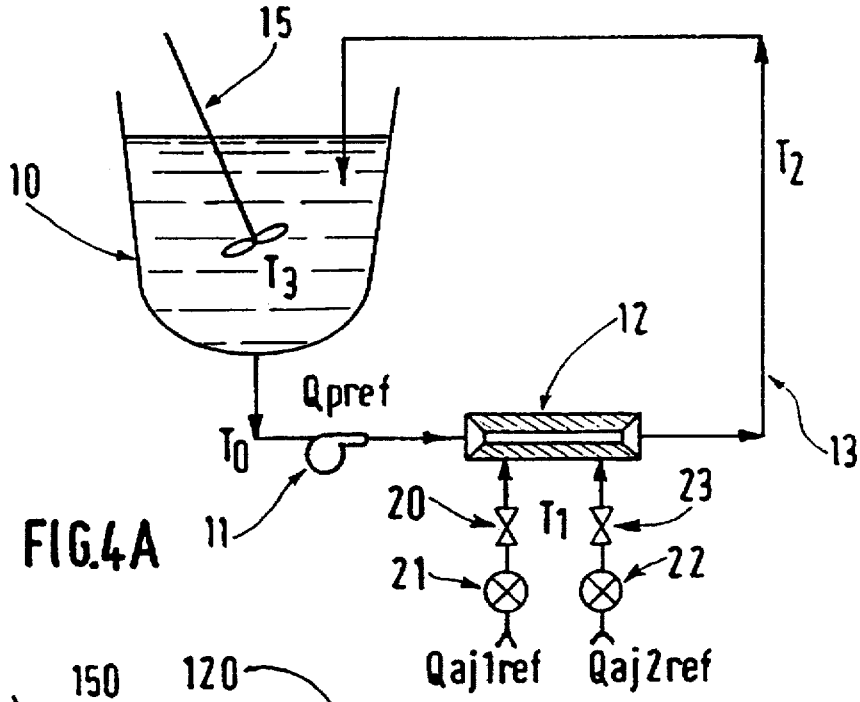
FIGS. 4A–4B depict diagrammatically another embodiment of the device according to the invention for changing from scale 1 to scale N.
Figure 4B:
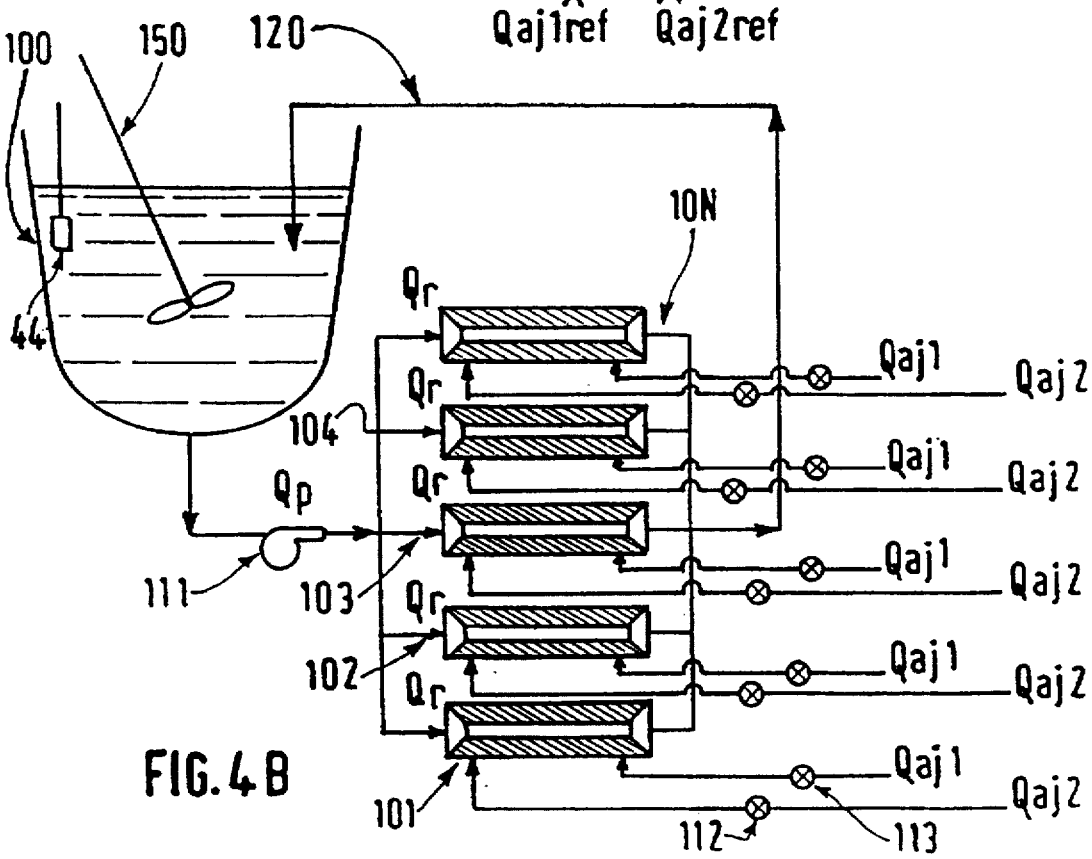

FIGS. 4A–4B illustrate diagrammatically another embodiment of the invention making it possible to resolve the aforementioned problem relating to a change from one scale to another.

Unlike the approaches known in the prior art, and according to which the change of scale (1 to N) was achieved by multiplying the volume of the vessel, the pumping rate and the volume of the reactor by N, the problem of the change of scale is resolved by using N external circulation loops as configured on scale 1 and disposed in parallels so that, by having a pumping rate in the vessel N times greater than the pumping used on scale 1, each of the N loops is put under flow rate and volume conditions identical to those determined on scale 1 with a single loop.

As illustrated in FIG. 4A, in a first step, the photographic emulsion is produced on a reference scale (in the laboratory, scale 1). For this purpose, a stirred solution of gelatin (together with, optionally, a halide salt) contained in a vessel 10 of volume $V_{ref}$ (at least equal to the volume of emulsion to be produced) is pumped 11 at a controlled flow rate $Q_p = Q_{pref}$ and sent into an external circulation loop 13 including a reactor 12 before being continuously recycled in the vessel 10. The stirring in the vessel depends notably on the volume of the vessel and the type of stirrer used. In practice, the stirring must be sufficient for a majority of grains sent into the evaporating vessel from the external circulation loop not to return directly into the circulation loop. As an indication, with a "marine" type propeller, the stirring speed for an evaporating vessel of 601 is around 300 to 500 rev/min.

At the reactor 12, a solution of silver salt (silver nitrate) is added at a flow rate $Q_{aj1ref}$ as well as, optionally, a solution of at least one halide salt (potassium bromide, sodium bromide, potassium chloride, sodium chloride, potassium iodide or sodium iodide, etc) at controlled flow rates $Q_{aj2ref}$ allowing the formation and growth of silver halide photographic grains. These mechanisms of formation and growth of the grains have been the subject of numerous publications, notably in the patent literature, and consequently require no further description. The design of the reactor is in accordance with that which was described previously for dealing with the problem relating to irreversibly insoluble species.

Once these parameters for the production of photographic emulsion on the reference scale (scale 1) with a single loop have been determined, the change to the production scale (for the production of a volume V of emulsion equal to N times the volume prepared with the reference device) takes place, as illustrated in FIG. 4B, using a vessel 100 with a volume at least equal to V and disposing in the circulation loop N external circulation loops 101, 102, 103, 104, 10N, substantially identical to each other and substantially identical to the loop of the reference device used on scale 1 (notably with respect to the length of the loops, the reagents, the position of the points of introduction of the reagents), the rate of pumping $Q_p$ (pump 111) into the vessel 100 being N tinges greater than the rate of pumping $Q_{pref}$ into the reference vessel 10 so that each circulation loop 101, 102, 103, 104, 10N receives a flow $Q_r=Q_p/N$. Each of the circulation loops receives, by means of appropriate valves and pumps 112, 113, the same reagents as those added to the loop of the reference device, and at rates $Q_{aj1}$, $Q_{aj2}$, equal to the rates $Q_{aj1ref}$, $Q_{aj2ref}$ of introduction of the additions to the reference loop 13, so that the quantity of reagents supplied to the whole system overall is equal to N times the quantity of reagents supplied to the reference system. There is thus a change from scale 1 to 10, or to 100, simply by adapting the size of the vessel 100 to the volume V of emulsion to be produced, by multiplying the number of reference loops by 10 or 100 and multiplying the rate of pumping into the vessel by 10 or 100.

In a well-known manner, during or after the phases of nucleation, growth and ripening, anti-fogging agents, growth modifiers, gelatin solutions, dopants, anti-foaming agents etc are added to the photographic solution. All these elements are introduced either into the vessel or into the loop, the dopants preferably being introduced into the external circulation loop, in which case, during a change of scale, they are introduced into each external circulation loop with a flow rate equal to the rate of introduction of the same dopants into a reference device with a single loop during the preparation of the same emulsion on scale 1. As an example of a dopant, iridium and selenium can be cited. Other dopants are listed in Research Disclosure, September 1994, Number 36544. For all other additions of elements to the vessel (anti-fogging agents, gelatin, growth modifiers), in the same manner as for the halide salt introduced directly into the vessel, the change of scale takes place by multiplying the rates by the scale factor.

As mentioned above, where the external circulation loops are of the type depicted in 3A, 3C or 3D, that is to say when a halide salt solution is introduced into the vessel, passing from scale 1 to N, the rate of arrival of the salt in the vessel is also multiplied by N.

According to a particular embodiment, upstream of the points of introduction of the reagents, there is disposed an ultrafiltration unit to continuously eliminate water and soluble salts, thereby enabling more dilute reagents to be used if necessary.

The invention that has just been described is particularly advantageous in that it makes it possible to resolve in a satisfactory manner the problem related to the production of so-called irreversibly insoluble species. In addition, there is a change from one production scale to another without having to make adjustments to the formulation of the photographic emulsion. Moreover, it enables a range of emulsions to be produced, simply by changing the type, number and entry point of reagents into the external circulation loop or loops.

EXAMPLE I

A 18 l evaporating vessel was initially filled with a mixture of 7.6 liters of water and gelatin, raised to 80° C., the temperature remaining constant throughout precipitation. Before the start of precipitation, sodium bromide and potassium iodide were added to the contents of the vessel. The precipitation consisted of an 88 min step, during which a 2.3M silver nitrate solution was continuously added at rates varying between 28.3 l/min and 85 l/min. The introduction of halide salts started only after the first 13.5 minutes of precipitation, where a solution of a mixture of sodium bromide and potassium iodide with a total concentration of 3.4M was added over 26.5 minutes at rates varying between 19 and 35 ml/min. During the remainder of the precipitation, a 3.9M sodium bromide solution was added at rates varying between 19 and 77 ml/min.

During the precipitation, the emulsion was pumped from the vessel and recycled by means of a pump and an external loop with a total volume of 884 ml. The emulsion is circulated at a flow rate of 20 ml/min, kept constant. Intake of the emulsion into the vessel was effected through a tube immersed in the medium and whose end was situated 5 cm from the bottom of the vessel and 10 cm from the edge. Discharge was effected through a tube diametrically opposite to the aforementioned one, and has an outlet provided with an anti-splash device. This was placed at 10 cm from the bottom. The vessel remained stirred during the precipitation by means of a marine propeller.

The reactor situated in the recirculation loop consisted of a tubular duct with a diameter of 12 mm and a length of 300 mm. The volume of the pipe between the evaporating vessel and the reactor was 570 ml. The reagents were introduced by injectors with a diameter of 2 mm. The silver salt was introduced upstream, relative to the direction of flow, and the halide salts downstream at a distance of 10 cm from the point of injection of the silver salt.

After precipitation, the presence of irreversibly insoluble species was found. These species were in the form of aggregates occupying almost all the cross section of the reactor tube, over a length of approximately 20 cm from the position of the silver salt injector.

EXAMPLE II

The procedure for producing the precipitation remained identical to Example I, along with the internal configuration of the vessel and the position of the take-off and delivery tubes in this evaporating vessel.

The reactor situated in the recirculation loop consisted of two tubular ducts each with a diameter of 8 mm and a length of 300 mm, these being placed in series so that the respective injectors for the silver salt and halide salt solutions were separated by 45 cm. The volume of the pipe between the vessel and the reactor was 570 ml. The reagents were introduced by injectors with a diameter of 0.7 mm, inclined at 90° with respect to the direction of flow. The silver salt was introduced upstream, relative to the direction of flow.

After precipitation, no irreversibly insoluble species are found to be present.

In the above description, reference was made to preferred embodiments of the invention. It is evident that variants can be made thereto without departing from the spirit of the invention as claimed hereinafter. By way of example, applications other than the preparation of photographic emulsions can be envisaged according to the present invention, such as the preparation of precipitates of barium sulphate.

We claim:

1. Method for preparing a silver halide photographic emulsion in which the contents of a vessel containing at least a stirred solution of gelatine is circulated in an external circulation loop including a reactor at which a first solution of a silver salt and second solution of a first halide salt are added thus forming a mixture, the silver salt solution being introduced at a point situated upstream of the point of introduction of the first halide salt solution, wherein the second solution of said first halide salt is introduced at a point in the loop situated outside a reaction zone within which the silver salt added to the loop produces a precipitation of silver halide grains or causes the silver halide grains to grow, wherein the silver salt solution is introduced into the reactor in the form of a centered jet within said reactor and wherein the Reynolds number at the point of introduction of the silver salt is between about 5000 and about 50,000.

2. Method according to claim 1, wherein the Reynolds number lies between about 15,000 and about 50,000.

3. Method according to claim 2, wherein the external circulation loop has, at the point of introduction of the silver salt solution, a diameter D and a flow rate V, the silver salt solution being brought into the loop at a flow rate v by means of a tube of diameter d, the ratio d/D lying between 0.05 and 0.5, the ratio v/V lying between 0.02 and 15.

4. Method according to claim 3, wherein the ratio d/D lies between 0.07 and 0.2 and wherein the ratio v/V lies between 0.2 and 3.

5. Method according to claim 4, wherein the loop is formed with a pipe having a diameter which lies between 6 mm and 15 mm.

6. Method according to claim 5, wherein the diameter of the pipe varies between 8 mm and 12 mm.

7. Method according to claim 6, wherein the points of introduction of the solution of silver salt and of the solution of the first halide salt are offset by a distance such that the average residence time of the mixture between the two points varies between 8 ms and 1000 ms.

8. Method according to claim 7, wherein the points of introduction of the solution of silver salt and of the solution of the first halide salt are offset by a distance such that the average residence time of the mixture between the two points varies between 30 ms and 200 ms.

9. Method according to claim 8, wherein a solution of a second halide salt is added to the vessel at a controlled flow rate.

10. Method according to claim 9, wherein a solution of a third halide salt is added to the circulation loop upstream of the point of introduction of the silver salt.

11. Method according to claim 10, wherein, during the growth of photographic grains, the silver salt and the first halide salt are introduced at at least two portions of the external circulation loop.

12. Device with an external circulation loop system for preparing a silver halide photographic emulsion comprising:

a) a vessel initially containing at least a stirred solution of gelatin;

b) pumping means for pumping the solution continuously into the vessel;

c) a plurality of external circulation loops, fed by the pumping means, each of the circulation loops including a reactor at which a first solution of a silver salt and a second solution of a first halide salt are added thus forming a mixture; the silver salt solution being introduced at a point situated upstream of the point of introduction of the first halide salt solution; and d) means for continuously recycling the output of each of the circulation loops in the vessel;

wherein the second solution of the first halide salt is introduced at a point in each loop situated outside a reaction zone within which the silver salt added to each loop produces a precipitation of silver halide grains or causes them to grow, wherein the silver salt solution is introduced into the reactor in the form of a centered jet within the reactor and wherein the Reynolds number at the point of introduction of the silver salt is between about 5000 and about 50,000.

13. Device according to claim 12, wherein the Reynolds number lies between about 15,000 and about 50,000.

14. Device according to claim 13, wherein each of the external circulation loops has, at the point of introduction of the silver salt solution, a diameter D and a flow rate V, the silver salt solution being brought into each loop at a flow rate v by means of a tube of diameter d, the ratio d/D lying between 0.05 and 0.5, the ratio v/V lying between 0.02 and 15.

15. Device according to claim 14, wherein the ratio d/D lies between 0.07 and 0.2 and the ratio v/V lies between 0.2 and 3.

16. Device according to claim 15, wherein each loop is formed with a pipe having a diameter which lies between 6 mm and 15 mm.

17. Device according to claim 16, wherein the diameter of the pipe varies between 8 mm and 12 mm.

18. Device according to any one of claim 17, wherein the tube forms an angle other than 90° with respect to the axis of the reactor and directed so that the silver salt is introduced in counter-flow with respect to the direction of flow in the reactor.

19. Device according to claim 18, wherein the angle is about 45°.

20. Device according to claim 19, wherein the points of introduction of the silver salt solution and of the first halide salt solution are offset by a distance such that the average residence time of the mixture between the two points varies between 8 ms and 1000 ms.

21. Device according to claim 20, wherein the points of introduction of the silver salt solution and of the first halide salt solution are offset by a distance such that the average residence time of the mixture between the two points varies between 30 ms and 200 ms.

22. Device according to claim 21, further comprising means for adding a solution of a second halide salt to the vessel at a controlled flow rate.

23. Device according to claim 22, further comprising means for adding a solution of a third halide salt to each circulation loop, upstream of the point of introduction of the silver salt.

24. Device according to claim 23, wherein during the growth of photographic grains, the silver salt and the first halide salt are introduced into at least two portions of each external circulation loop.

25. Device according to claim 24, further comprising N substantially identical, external circulation loops fed by pumping means and disposed in parallel so that each of the loops receives a same flow rate of the mixture.

26. Device according to claim 25, further comprising means for measuring the pAg disposed in the loops downstream of the area of introduction of the silver salt and the halide salt.

27. Device according to claim 25, further comprising means for measuring the pAg disposed in the vessel.

* * * * *